US005991939A

United States Patent [19]

Mulvey

[11] Patent Number: 5,991,939

[45] Date of Patent: Nov. 30, 1999

[54] POOL SAFETY VALVE

[75] Inventor: Kevin Mulvey, Ft. Pierce, Fla.

[73] Assignee: VAC-ALERT Industries, Inc., Ft. Pierce, Fla.

[21] Appl. No.: 09/020,265

[22] Filed: Feb. 6, 1998

Related U.S. Application Data

[60] Provisional application No. 60/056,223, Aug. 21, 1997.

[51] Int. Cl.[6] ..... E04H 4/06

[52] U.S. Cl. ..... 4/504; 137/526; 4/509

[58] Field of Search ..... 4/504, 507, 509, 4/541.2; 137/526

[56] References Cited

U.S. PATENT DOCUMENTS

| | | | |
|---|---|---|---|
| 953,825 | 4/1910 | Gekeler | 137/526 X |
| 4,569,208 | 2/1986 | Villa | 137/526 X |
| 5,419,366 | 5/1995 | Johnston | 137/526 X |
| 5,682,624 | 11/1997 | Ciochetti | 4/509 |
| 5,822,807 | 10/1998 | Gallagher et al. | 4/507 |

FOREIGN PATENT DOCUMENTS

| | | | |
|---|---|---|---|
| 199541 | 6/1923 | United Kingdom | 137/467 |

*Primary Examiner*—Robert M. Fetsuga

[57] ABSTRACT

A valve designed to bleed air in to the suction line of a pool when the suction pressure exceeds a predetermined value. The valve is housed in a four port fixture in which the ports are designated as the first, second, third and forth ports. Each port has a central axis with all the central axes lying in a single plane. The central axes of the first and third port lie on a first straight line and the axes of the second and forth port lie on a second straight line. The first and second line cross one another orthogonally which places the first and third ports opposite one another and the second and forth port opposite one another. The second and forth ports each contain an individual moveable element which has a first and a second position. In the first position the moveable element blocks the port. In the second position the port is opened and will admit air into the valve. A resilient element connected between the moveable elements produces a force which urges the moveable elements into their first position where they block their respective ports, but the force produced by the resilient element can be overcome by a predetermined suction force within the valve. Water flows through the valve from the first to third port. A suction level which produces a force on the moveable elements that exceeds the predetermined force will open the second and forth ports and admit air into the valve.

4 Claims, 3 Drawing Sheets

POOL SAFETY VALVE

This application claims benefit of Provisional Application No. 60/056,223 filed Aug. 21, 1997.

BACKGROUND

1. Field

The present invention relates to pressure safety valves and more specifically to automatic pressure valves used with swimming pools and spas to relieve suction pressure in drains as necessary to avoid injury.

2. Prior Art

Pools typically have a single drain at their bottom to remove water from the pool which is then circulated through a pump and filter before it is returned to the pool. There have been a number of very serious injuries caused by the use of single drains in swimming pools. The suction in the drain has held children under the water resulting in drowning. In other instances, children sitting on the drain have been disemboweled by the suction force of the pump coming through the drain. Prior art attempts to prevent this include placing two drains at the bottom of a pool so that if one is closed off, the water is drawn through the second drain, thereby preventing the build up of excessive suction at the closed off drain. This arrangement permits a person held to a drain to pull themselves away from it more easily and with little or no damage. However, the problem remains with many single drain pools that have their drains set in concrete. A second drain could be installed in such pools, but usually at great expense because it often requires the breaking up of the bottom of the pool to install the second drain. As a result, virtually none of the existing single drain pools have been retrofitted in this manner and there remains a need to provide an affordable system for preventing such injuries.

SUMMARY

The present invention is a safety valve which provides a means of disabling the pump in single drain pools when the suction pressure level in the drain line exceeds a predetermined safe level. When this occurs, such as when a person is trapped by a drain because of the suction at the drain, the valve automatically opens to let air into the drain line. This immediately reduces the suction pressure level in the drain and releases the trapped person. It also causes the pump to lose prime, preventing it from immediately starting again. This gives the trapped person time to exit the pool before there is a repetition of the original problem. The valve also has an automatic locking system which locks the valve in an open position that continues to bleed air into the system until the locking system is manually reset, thereby providing further assurance that a person who has been trapped can escape without being recaptured.

The present invention is a pressure sensitive valve that is placed in the drain line of a pool so that it is in series with and carries the flow of water through the drain line. This valve contains a moveable element which is normally in a position that closes a port to outside air. The moveable element is held over the port by a resilient means which yields to allow the moveable element to move away from the port and admit air to the drain line when the suction pressure level in the drain line exceeds a predetermined safe level.

DETAILED DESCRIPTION OF THE INVENTION

Figure 3:
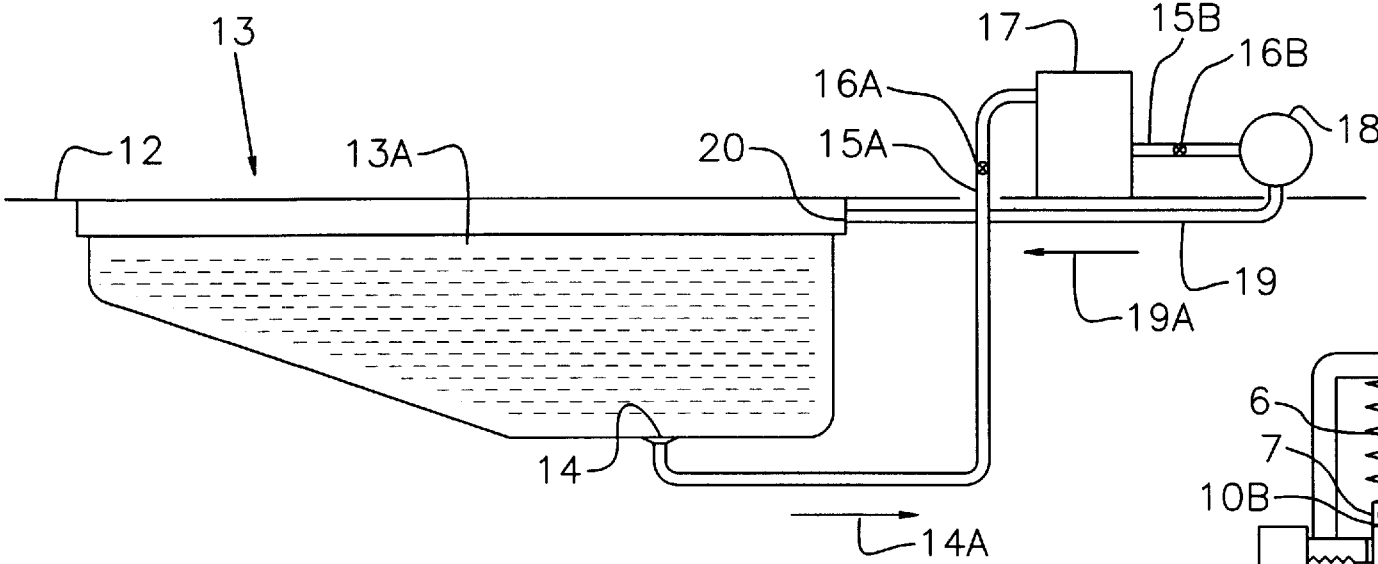
FIG. 3 is a schematic diagram of a pool and the system generally used to circulate the water through a filter.

FIG. 3 shows a schematic diagram of a swimming pool 13 containing a body of water 13A. This Figure also shows the components associated with a typical pool system including, a pool drain 14, a first drain line segment 15A, a second drain line segment 15B, a first safety valve location 16A, a second safety valve location 16B, a filter 17, a pump 18, a return line 19 and a return line output port 20. The filter and pump both have input and output ports to permit the entrance and exiting of water from these devices. The filter cleans the water that passes through it by removing small particles. The water emerging from the output of the filter is referred to as filtered water.

The first drain line segment connects the drain, which is usually located at the bottom of a pool, to the input of the filter, which is usually located above the ground surface level 12. The output of the filter is connected by the second drain line segment to the input of the pump. To complete this system, the pump output is connected to the return line output port by the return line. These connections are in series and they permit the flow of water from the pool through the pump and filter and then back to the pool.

In the operation of this system, the pump produces a reduced pressure level referred to as a suction level or simply a suction at its input which draws water from the pool through the drain, the drain line, and the filter and then the pump returns the filtered water through the return line and return line output port to the pool. The purpose of this system is to produce a constant supply of filtered water to the pool as long as the pump is operating.

In FIG. 3, the pump is shown placed on the output side of the filter. It could also be placed on the input side of the filter, such as at point 15A. In this latter location, it would draw water through the drain line and then pump it through the filter. The system will function with the pump in either location; however, locating the pump at point 15A is often preferred because the relative high water pressure produced at the output of the pump is used to overcome the generally high resistance to the flow of water normally encountered in the filter.

The direction of water flow through the drain line is indicated by arrow 14A, while the direction of flow through the return line is indicated by arrow 19A. The safety valve of the present invention is placed in the system at a point before or "up stream" of the pump. The valve is in series with and becomes a part of the drain line continuing the flow of water through the drain line after its installation in this line. Location for the valve that are "up stream" can be seen in FIG. 3. For example, the valve may be placed at point 16A which is in series with the first segment of the drain line 15A and immediately before the filter or the valve may be placed at point 16B which is in series with the second segment of the drain line 15B and immediately before the pump. If the pump were moved from the location shown in FIG. 3 to point 16A in the first segment of the drain line, then the valve would have to be placed in the first segment of the drain line before the pump.

The valve must be placed in the system before the pump to bleed air into the drain line and into the pump in order to reduce the suction level in the drain line and disable the pump. If the valve were placed after the pump, such is in the output line, it could not relieve the suction level in the drain line because it would be connected to a portion of the system where the water flow is discharged into the pool and not into the pump. Any air entering the output line would never reach the drain line or the pump. Finally, the valve only functions where there is a suction pressure level in the line which draws air in to the valve when a port in the valve is opened to the air. That occur only when the valve is placed in the drain line where the pump produces a reduced pressure level as compared to the outside atmospheric pressure of the air. The output line has a positive pressure level with respect to the outside atmospheric air pressure and would not only not take in air through a port exposed to the air, but would instead eject water from such a port.

Figure 1:
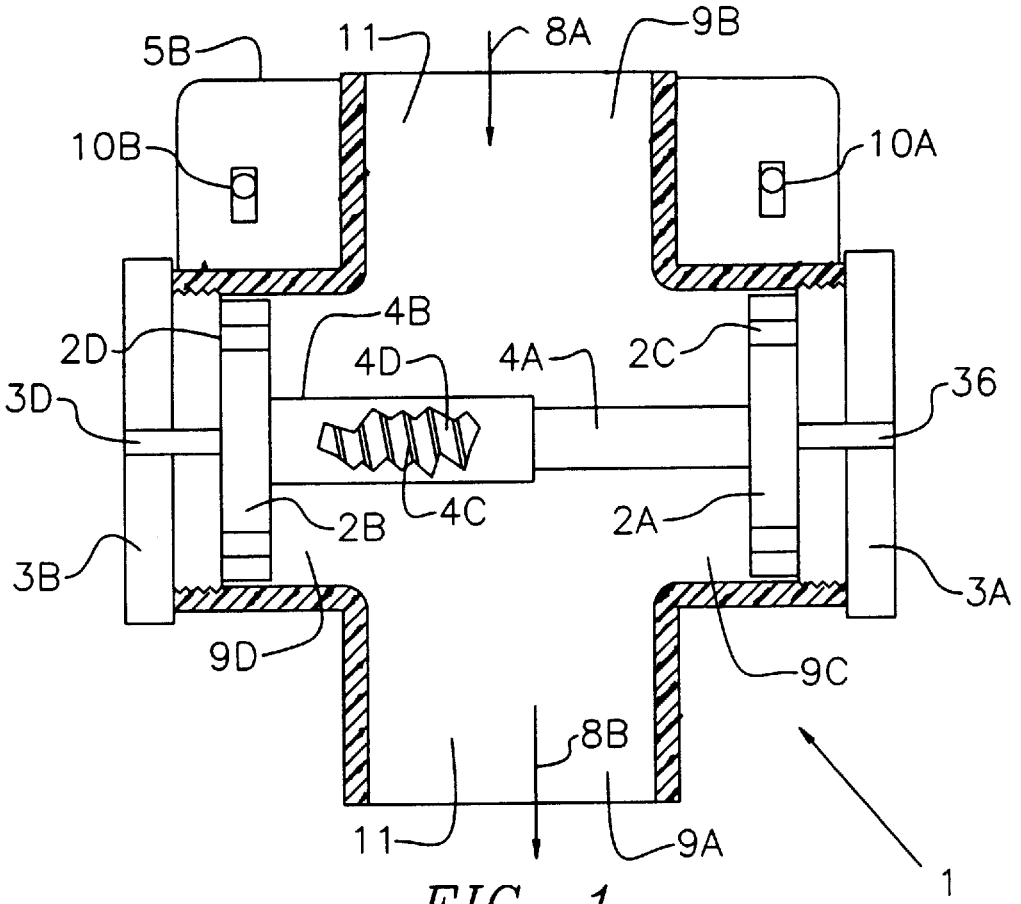
FIG. 1, is a sectional plan view of the automatic safety valve of the present invention showing the flow of water through the main passageway of the valve as well as the valve components which are located on either side of this passageway.

The operation of the valve can be explained with the aid of FIG. 1. In a preferred embodiment, the valve is housed in a four port PVC fixture, which is indicated in this Figure by cross hatching. The four ports of this fixture are designated by drawing numerals 9A through 9D. The water input port is 9B, while the water output port is 9A. These two ports form the entrance and exit respectively of a passageway 11 through the valve which carries the flow of water through the valve. The direction of water flow through this passageway is indicated by arrows 8A and 8B. The remaining two ports, 9C and 9D, which are located on either side of the passageway, are used to house the operating components of the valve.

These components include a right and a left valve slide 2A and 2B, a right and a left end cap 3A and 3B, a right and a left valve shaft 4A and 4B and a valve spring 4C. The right and left valve shafts are cylindrical projections from the right and left valve slides respectively and extend towards the middle of the valve. The left valve shaft 4B contains a spring 4C within its hollow center 4D. The position of the spring 4C within the valve shaft 4B is shown in FIG. 1 through the break away view of the left valve shaft. The valve slides are generally vertically positioned discs which contain holes that pass through them in the horizontal direction. These holes are located near the outer periphery of the valve slides as can be seen from the location of holes 2C and 2D shown in FIG. 1. The end caps are also generally vertically positioned discs, but are not moveable because they are secured about their periphery to ports 9C and 9D. The end caps cover these ports completely, however, they include a hole at their centers indicated by drawing numerals 3C and 3D.

The components of the valve including the four port fixture, the end caps, the valve slides, the valve shaft can be made of PVC which has the advantage of long life without concern for corrosion. To provide the same long life properties for the spring, it is typically made of titanium steel. The valve shafts may either both be hollow to contain the spring, or only a single shaft may be hollow to contain the spring and also slide over the remaining shaft.

In the operation of this invention, the right valve shaft 4A fits inside the left valve shaft 4B and can slide within this shaft. Since the valve shafts are projections of the valve slides, each valve shaft moves the valve slide that it is connected to. The valve spring 4C is biased to urge the valve shafts apart in the horizontal direction, forcing the valves slides to move and stay positioned against the end caps, until they are moved away by the suction force of the water flowing through the valve, which overcomes the force of the spring. Both the valve slides and the end caps have smooth vertical faces that are parallel and are positioned immediately adjacent to one another. When the valve slides are pressed against the end caps by the valve spring pressure, they form a closed, air tight seal and, as a result, no air enters the valve through the holes 9C and 9D in the end caps, as long as the valve slides and the end caps remain in contact with one another in the manner described.

The normal suction pressure level of the water within the valve acts on the valve slides, tending to pull the valve slides away from the end caps, however, the pressure exerted by the spring against the valve slides holds the valve slides against the end caps and keep the valve in a closed position. The spring pressure is adjusted to a predetermined level to allow the slides to be pulled in towards the center of the valve by an increase in suction pressure level over a normal level caused by a person blocking a drain.

Figure 4:
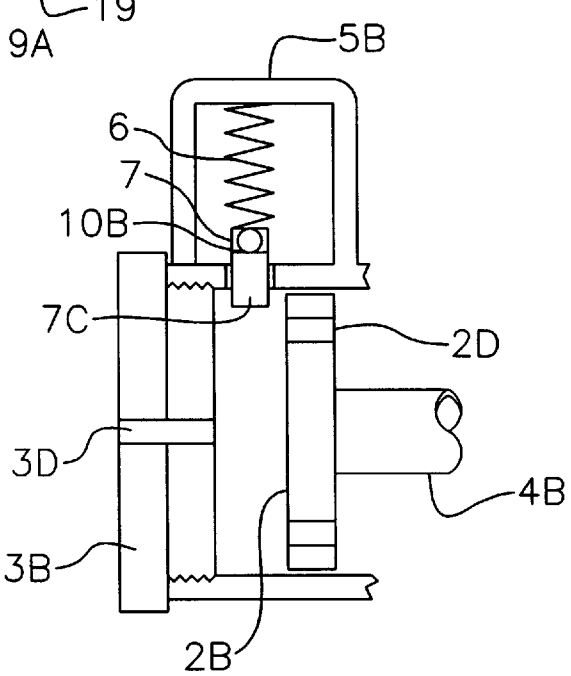
FIG. 4 is a cross sectional view of the valve's front elevation showing the details of a latching mechanism contained within the valve.

Since the left and right valve locks are essentially identical, the operation of the valve locks will be described by considering the left valve lock, shown in FIG. 4. As can be seen in this Figure, once a valve slide has pulled away from the end cap, it is locked in this open position by the valve lock 7 which is a finger that initially rides along the peripheral side of the valve slide as the valve slides move away from its port. When the valve slide has moved sufficiently far from its port to fit the valve lock, the valve lock is urged in between the valve slide and the end cap by spring 6 which is positioned above and in contact with the valve lock. The springs for the right and left valve locks are contained in housings 5A and 5B which are mounted on the four port fixture adjacent ports 9C and 9D, respectively. The position of the valve lock in FIG. 4 holds the valve in an open position to admit air into the passageway 11.

Figure 2:
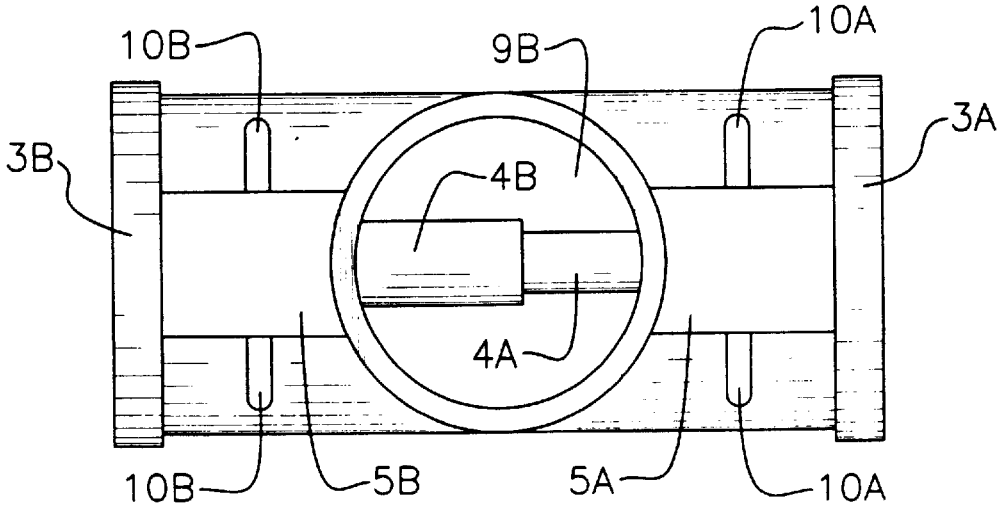
FIG. 2 is a side elevation of the safety valve providing a view into the main passageway through which the valve rods can be seen.

As soon as the valve slide is moved away from the end cap, air is drawn into the valve through the holes, such as 3C and 3D, in the end caps and the holes, such as 2C and 2D, in the valve slides. The air is sucked into the pump reducing the suction at the drains and quickly causing the pump to lose prime, which reduces the suction level to zero and results in releasing anyone trapped by the drain. The valve locks hold the valve slides away from the end caps until the locks are manually reset by lifting the locks up with release levers 10A and 10B, which are connected to the valve locks, as shown in FIGS. 4. The lever ends extending out of the lock housings 5A and 5B to make them accessible for manual actuation are visible in FIGS. 1 and 2. Lifting the levers allows the valve slides to return to their normal position against the end caps and set the valve to a closed position.

As noted above, the spring pressure is adjusted to a predetermined level to allow the slides to be pulled towards the center. The adjustment of the spring is considered as providing a means for sensing the water suction level within the value because once this has reached the predetermined level, the spring allows the value slides to move. The movement of the value slides away from the end caps is considered as a means for commencing the bleeding of air into the drain line because once the value slides have been moved in this manner, air can flow through the end caps and into the value as well as on and into the drain line.

Although many equivalents that fall within the spirit and scope of the present invention will be evident to those skilled in the art, the selection of the elements that comprise the above described preferred embodiment were made because they provide a number of practical advantages. For example, a single port valve may be substituted for the two port valve shown in the preferred embodiment. However, two ports admit air at a faster rate than a single port and the present invention can continue to perform even if one valve becomes inoperative. In this way, the preferred embodiment provides an additional safety factor because of this redundancy of a critical component.

The components of the valves and the valves themselves have been placed in a convenient position within the drain line and that position, as shown in the Figures, has been used to aid in describing the operation of the valve; however, other orientations for the valve or the components and direction of movement of the components are possible, but are often inconvenient mechanically, and in any event, are generally equivalent and remain within the spirit and scope of the present invention.

A two port fixture may be substituted for the four port fixture used in the preferred embodiment; however, the four port fixture already contains side ports which do not have to be machined into the side of the fixture as they would in a two port fixture. In addition, the four port fixture has room in its two side ports to accommodate most of the valves critical components and the four port fixture is readily available at low cost. Similarly, the end caps, which are used as an important valve components, are also readily available at low cost. Most importantly, the preferred embodiment has been built and tested and has performed successfully, meeting all the requirements of a pool safety valve repeatedly and without difficulty.

Figure 5A:
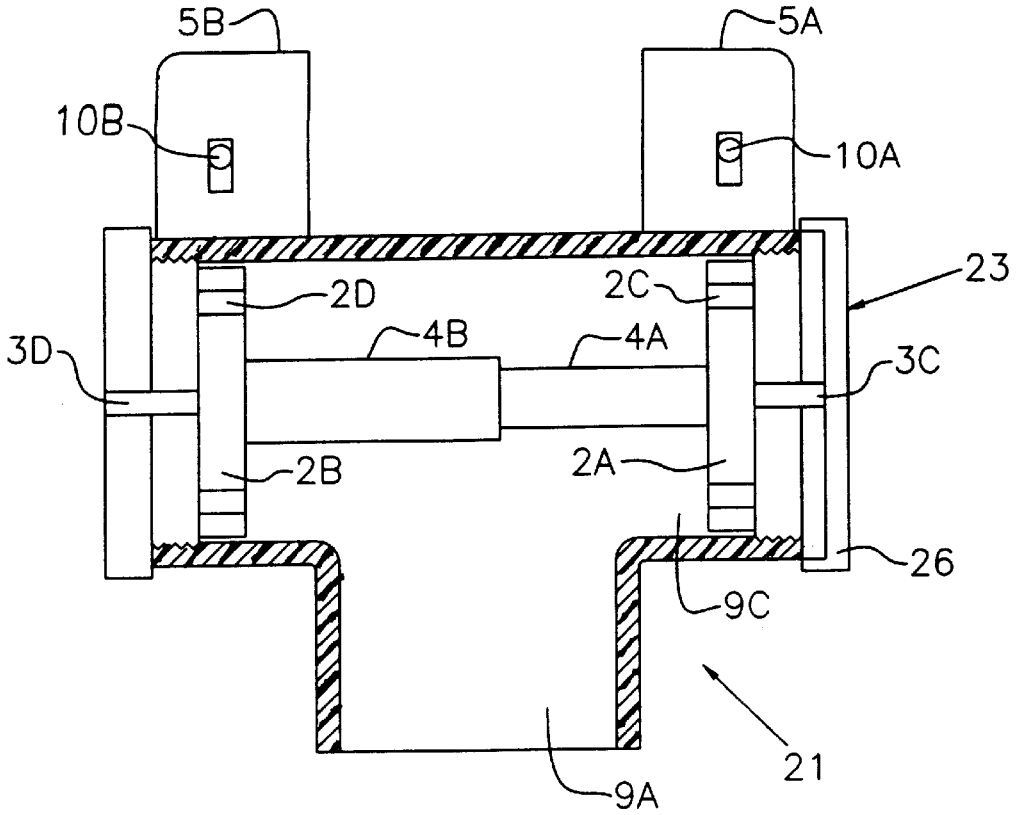
FIG. 5A is a cross sectional view of a variation of the valve shown in FIG. 1 where one port of the valve is closed.
Figure 6:
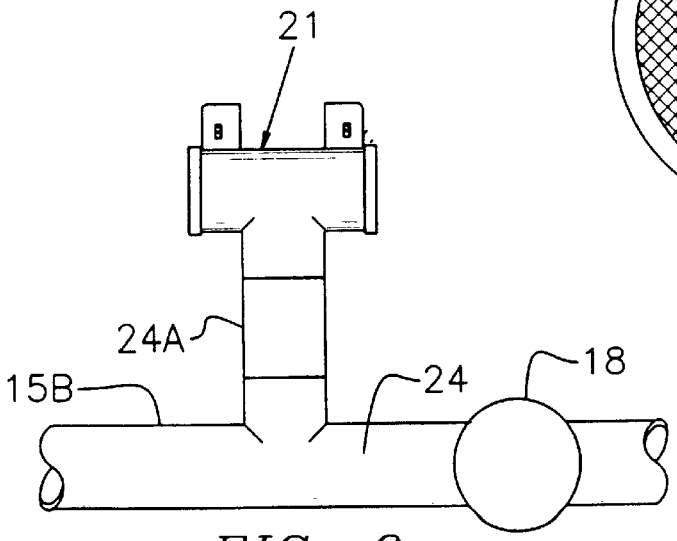
FIG. 6 is schematic view of a drain line and pump showing the location and method of installation of the valve shown in FIG. 5A.

It will be clear to those skilled in the art that any valve which is designed to admit air into the drain line when the drain line suction level exceeds a predetermined value is an equivalent falling within the scope of the present invention. An example of such a valve is shown in FIG. 5A and FIG. 6. The valve 21 in FIG. 5A is identical to the valve 1 shown in FIG. 1 except that port 9B has been closed off completely. To simply the drawings, the drawing numerals used in FIG. 1 are identical to those used in FIG. 5A for identical components. As a practical matter, the valve shown in FIG. 1 can be converted to the valve shown in FIG. 5A by simply sealing port 9B with a cap, thereby permitting the same valve to be used, if desired, in a plurality of installations.

To use this valve, a tee connection is made in the drain line before a pump such as tee 24 which is located in the drain line 15B before pump 18, as shown in FIG. 6. When the suction pressure in the drain line exceeds a predetermined level, valve 21 opens and bleeds air into the drain line via the tee 24. The placement of the valve 21 above and away from the drain line as shown in FIG. 6 is advantageous because the valve itself is not located in the flow of water through the drain line, thereby reducing the possibility of corrosion of the spring 4C within the valve.

An equivalent arrangement is to place the valve at a point on a level with or below the drain line, but have the connection to the tee rise up and then come down to the valve. As long as there is sufficient air pressure in the line connecting the valve to the drain line, water will not flow to the valve.

There is usually a tee connection already existing in most pool systems at a location immediately before the pump which greatly facilitates the installation of the valve of the present invention. This tee is the pump clean out trap which typically contains a basket to catch any debris before it reaches the pump. This tee is normally covered with a threaded plate or another similar detachable plate that maintain a water tight seal when in place, but which can easily be removed to enable the basket within this tee to be withdrawn for cleaning. A section of pipe such as pipe 24A in FIG. 6 is attached to port 9A of the valve 21. This pipe is adapted to be connected to the tee by replacing the cover plate. In this way, the valve may be installed in existing swimming pool systems without any modification of the system. This enables the home owner with a pool to purchase a valve and install it himself the same day it was purchased in a matter of minutes, an important advantage in view of the cost savings and the important of having such a safety device added to every pool system.

The valve construction as shown in FIGS. 1 and 6 has additional advantages worth of note. It is possible by pushing a rod through holes 3C and 3D in the end caps 3A and 3B against the valve slides 2A and 2B to simply and easily check the operation of the valve. This is a manual check which can be carried out from outside the valve. If the spring is still flexible and the valve slides are not stuck, the valve slides will move in towards the center of the valve and snap back. The pressure at which this occurs should be the predetermined level and this can be verified by using a pressure gage on the rod to ascertain at what pressure the valve slides move away from the end caps. Where holes 3C and 3D are large enough, a finger may be inserted to check the function of the valve without the need for a rod.

To make a quick manual check possible, the holes 3C and 3D in the end caps are widened to allow a finger to enter and contact the valve slides. Then a check of the valve can be made by simply forcing the valve slides to move by finger pressure. If the valve slides do not move or the pressure is required to move them is greater than normal, the valve should be open and checked. The opening and checking of the valve can be carried out by unscrewing the end caps, an operation which can be done easily manually without any tools.

Figure 5B:
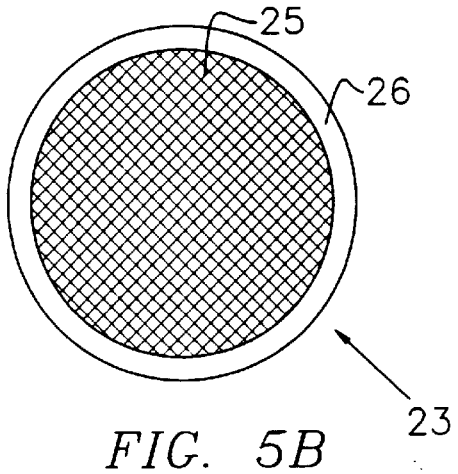
FIG. 5B is a side elevation view of a screen cap used to protect the valve slides from debris.

The holes 3C and 3D in the end caps are protected from collecting debris by screen caps, such as cap 23 shown in FIG. 5B. This cap contains a cylindrical outer rim 26 which supports a screen 25. The screen extends across an open end of the outer rim. The outer rim is adapted to slip over an end cap, such as end cap 3A as shown in FIG. 5A to hold the screen in place over the hole in the end cap. The screen allows air to enter the hole in the end cap while protecting the valve from debris which might cause jamming of the valve slides. The rim is designed to be forced over the end cap 3A by means of hand pressure, enabling it to be removed easily to facilitate manual checking of the valve.

What is claimed is:

1. A safety system for a drain in a swimming pool wherein the drain is connected by way of a drain line to a means for producing suction, the suction being transmitted through said drain line to said drain, said means for producing suction being designed to draw water from said pool through said drain line, the withdrawal of water through the drain line creating a flow through the drain line, said safety system comprising:

(a) means for sensing the suction level in said drain line, (b) means for commencing the bleeding of air into the drain line to reduce the suction level in the drain line after the suction level in said drain line has exceed a predetermined level, (c) means for continuing to bleed air into the drain line after said drain line suction level has once exceed said predetermined level, said bleeding of air into said drain line automatically continuing despite the suction level in the line falling below said predetermined level, and (d) means for resetting said means for continuing to bleed air into said drain line to terminate the bleeding of air into said drain line, and wherein said means for commencing the bleeding of air into said drain line comprises a valve in series with said drain line, said valve having a housing which contains a passageway that passes through said housing to pass the flow of water from said drain line through said valve, said valve having an open and a closed position in which said open position exposes the flow within the valve and the drain line to air from outside the valve and the closed position prevents air from reaching the flow within the valve and drain line, said valve further comprises a first port through which air from outside the valve may be bled into the passageway within the valve and into the drain line, a first moveable element having a first and second position, the first position being in contact with and closing said first port and the second position being away from and opening said first port to expose the flow within the valve and drain line to air from outside said valve by way of said first port, and means for moving said first moveable element to close said first port when the suction level in said valve and drain line is below said predetermined level and to open said first port when the suction level in said valve and drain line exceeds said predetermined level, said means for moving said first moveable element includes resilient means biased to resist the movement of said first moveable element away from said first port to prevent opening said first port until the suction level in said drain line exceeds said predetermined level, said passageway within said valve contains a center and said first moveable element is positioned within said valve adjacent said first port and is free to move away from said first port in a direction which is generally towards the center of said passageway against the resistance of said resilient means, said means for moving said first moveable element includes the suction level in said drain line acting on said first moveable element in a direction generally towards the center of said valve, said valve further comprised a second port through which air from outside the valve may be bled into said drain line and a second moveable element located inside said valve and adjacent said second port, said second moveable element having a first and a second position, the first position being in contact with and closing said second port and the second position being away from said second port in a direction towards the center of the passageway to expose the flow within the valve and the drain line to air from outside the valve by way of said second port, and said valve further comprising a second resilient means biased to resist the movement of said second moveable element away from the second port to prevent opening said second port until the suction level in said valve and drain line exceeds said predetermined level, said second port being positioned diametrically opposite said first port on said valve to enable said first and second resilient means to be combined into a single spring having a first and second end with the spring being extended from its first to its second end between said first and second moveable elements to provide resistance to the movement of these elements towards the center of the valve, and said valve further comprising a first hollow projection extending inwardly towards the center of the valve from said first moveable element and generally surrounding said spring, and a second hollow cylindrical projection inwardly towards the center of the valve from said second moveable element and generally surrounding and slideably moving over said first hollow cylindrical projection to orient and direct the force of said spring against the movement of said first and second moveable elements.

2. A safety system as claimed in claim 1 further comprising a latching means to hold said first moveable elements away from said first port once said first moveable elements has been moved by a suction pressure level exceeding said predetermined level, said latching means comprising a finger in slideable contact with a peripheral side of said first moveable element and said latching means further comprising a second resilient element urging said finger against said first moveable element, said finger sliding along said peripheral side of said first moveable element as said first moveable element is moved towards the center of the drain line, said finger being urged between said first port and said first moveable element by said second resilient element after said first moveable element has moved away from said first port sufficiently to permit said finger to fit between said first port and said first moveable element, the position of said finger between said first port and said first moveable element preventing said first moveable element from returning to a position adjacent said first port until said finger is removed from its position between said first moveable element and said first port.

3. A safety system as claimed in claim 2 further comprising a latching system release which includes means to withdraw said finger from its position between said first moveable element and said first port to permit said first moveable means to return to its position adjacent said first port by means of the bias of said first resilient means when said drain suction pressure level falls below said predetermined level.

4. A safety valve as claimed in claim 3 wherein said valve is housed in a four port fixture wherein the fixture ports are designated as the first, second, third and forth fixture ports, all four fixture ports being generally circular and each having a central axis passing through the center of each fixture port with each axis being generally perpendicular to the plane of its respective fixture port, the axis of the first and third fixture ports lying on a first line and the axes of the second and forth fixture ports lying on a second line, said first and second lines lying in a single plane which is generally orthogonal to the plane of each of the fixture ports and said first and second lines intersecting one another orthogonally, the first fixture port being designated as the valve input port and the third port being designated as the valve output port, said first passageway through said valve lying between said first and third fixture ports to pass the flow of water through said valve, said second and forth fixture ports having a second passageway between them which intersects said first passageway, said second and forth fixture ports serving as the valves first and second ports to bleed air into the flow of water through the first passageway.

* * * * *